US007664418B2

(12) United States Patent
Kotani

(10) Patent No.: US 7,664,418 B2
(45) Date of Patent: Feb. 16, 2010

(54) IMAGE FORMING APPARATUS WITH FUSING ROLLER THAT IS PREHEATED

(75) Inventor: Masaki Kotani, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 262 days.

(21) Appl. No.: 11/939,463

(22) Filed: Nov. 13, 2007

(65) Prior Publication Data

US 2008/0118261 A1 May 22, 2008

(30) Foreign Application Priority Data

Nov. 16, 2006 (JP) ..... 2006-310368

(51) Int. Cl.
*G03G 15/20* (2006.01)

(52) U.S. Cl. ..... 399/70; 399/69

(58) Field of Classification Search ..... 399/67, 399/69, 70

See application file for complete search history.

(56) References Cited

U.S. PATENT DOCUMENTS

| | | | | |
|---|---|---|---|---|
| 4,996,567 | A * | 2/1991 | Watarai et al. | 399/70 |
| 6,172,762 | B1 | 1/2001 | Uchiyama | |
| 6,335,797 | B1 * | 1/2002 | Hirosawa | 399/70 X |
| 6,359,642 | B1 | 3/2002 | Smith et al. | |
| 7,113,719 | B2 * | 9/2006 | Kubota | 399/70 |
| 7,142,122 | B2 * | 11/2006 | Butikofer et al. | 399/70 X |
| 7,154,518 | B2 * | 12/2006 | Kim | 399/69 X |
| 7,171,135 | B2 * | 1/2007 | Nishizawa et al. | 399/70 |

FOREIGN PATENT DOCUMENTS

| | | |
|---|---|---|
| JP | 51051332 U | 5/1976 |
| JP | 58-004167 | 1/1983 |
| JP | 05-341691 | 12/1993 |
| JP | 06342348 A | 12/1994 |
| JP | 11-102140 | 4/1999 |
| JP | 2000218905 A | 8/2000 |

OTHER PUBLICATIONS

Japanese language office action and its English language translation for corresponding Japanese application 2006-310368 lists the references above.

* cited by examiner

*Primary Examiner*—Sandra L Brase
(74) *Attorney, Agent, or Firm*—Hogan & Hartson LLP

(57) ABSTRACT

A fusing roller in an image forming apparatus heats and fuses a developed image transferred to a recording medium. A heat generator is controlled to maintain a detected temperature of the fusing roller at a reference fusing temperature until a predetermined time period is elapsed from when a trigger signal for starting preheating provided prior to entry of a print command is entered, and is stopped when the predetermined time period elapses. The fusing roller is rotated while being heated until the detected temperature once reaches the reference fusing temperature, and thereafter the detected temperature is maintained at the reference fusing temperature until the predetermined time period elapses by heating but not rotating the fusing roller.

19 Claims, 5 Drawing Sheets

IMAGE FORMING APPARATUS WITH FUSING ROLLER THAT IS PREHEATED

CROSS-REFERENCE TO RELATED APPLICATIONS

This application claims priority under 35 U.S.C 119 to Japanese Patent Application No. 2006-310368, filed on Nov. 16, 2006, which application is hereby incorporated by reference in its entirety.

BACKGROUND OF THE INVENTION

1. Field of the Invention

The present invention relates to an image forming apparatus including a fusing roller that heats a developed image transferred to a recording medium and fuses the same on the recording medium.

2. Description of the Related Art

In an image forming apparatus of this type, reduction of the time required from reception of a print command until the start of an actual printing process is demanded. In addition, improvement of technology to adjust the temperatures of a fusing roller and its peripheral components is also demanded because waving or curling of a recording medium may result when there are temperature fluctuations of the fusing roller or a significant temperature difference between the fusing roller and the peripheral components (for example, a nip roller) during fusing. When the fusing roller is rotated longer than necessary, increased power consumption and noise may result. Therefore, rotation of the fusing roller should be restrained as much as possible.

In order to facilitate quick heat-up of the fusing roller, countermeasures such as reduction of the thickness (reduction of heat capacity) of a metal tube which constitutes the fusing roller, and arrangement of a heater at a position deviated from the axis of rotation of the fusing roller, are now in progress. However, such countermeasures increase the possibility of temperature fluctuations in the fusing roller and temperature differences between the fusing roller and the peripheral components (for example, abrupt increase of the temperature of the fusing roller in comparison with the peripheral components when heated).

In order to restrain temperature fluctuations and temperature differences from the periphery of the fusing roller, it is useful to heat the fusing roller while it is being rotated. However, increasing rotation of the fusing roller may increase noise and power consumption.

SUMMARY OF THE INVENTION

Accordingly, the invention provides an image forming apparatus in which a fusing roller is preheated while restraining temperature fluctuations and temperature differences from peripheral components considering noise and power consumption, so that the time required to start an actual printing process from when a print command is received is reduced.

In an image forming apparatus according to a first aspect of the invention a fusing roller heats and fuses a developed image transferred to a recording medium. A heater heats the fusing roller. A temperature detection sensor detects the temperature of the fusing roller or of the periphery thereof. A motor rotates the fusing roller. A control unit controls the heater and the motor on the basis of the detected temperature from the temperature detection sensor. The control unit controls the heater to maintain the detected temperature at a reference fusing temperature until a predetermined time period is elapsed from an entry of a trigger signal for starting preheating provided prior to an entry of a print command, and stops the heater when the predetermined time period has elapsed. The control unit operates the motor until the detected temperature reaches the reference fusing temperature in a case in which the temperature detected when the trigger signal is entered is lower than the reference fusing temperature, and stops the motor when the detected temperature reaches the reference fusing temperature.

In a second aspect of the invention, when trigger signals are entered a plurality of times during a time period from one fusing process to a next fusing process carried out by the fusing roller, the control unit does not carry out control to preheat the fusing roller for entries of trigger signals from the second time onward.

In a third aspect of the invention, a cooling fan controlled by the control unit for cooling the fusing roller and the periphery thereof is provided. The control unit causes preheating to be carried out without operating the cooling fan when a trigger signal is entered for the first time and causes preheating to be carried out with the cooling fan operated when trigger signals are entered from a second time onward during a period from one fusing process to a next fusing process carried out by the fusing roller.

In a fourth aspect of the invention, the image forming apparatus includes a copying function, and the trigger signal is provided in association with opening of a platen cover of a flat bed scanner, set-up of a document on an auto document feeder unit, or selection of a Copy mode.

According to the first aspect of the invention, since the fusing roller is preheated prior to the print command, the time required from reception of the print command until start of the actual printing process is shortened.

If the detected temperature of the fusing roller or the periphery thereof is lower than the reference fusing temperature when the trigger signals for starting preheating are entered, the fusing roller is heated while being rotated until the detected temperature reaches the reference fusing temperature. By rotating the fusing roller during preheating of the fusing roller, the fusing roller is preheated while restraining temperature fluctuations of the fusing roller or temperature differences from peripheral components (for example, a nip roller).

When the detected temperature once reaches the reference fusing temperature after a trigger signal, the fusing roller is thereafter preheated with rotation of the fusing roller stopped. When the predetermined time period from entry of the trigger signal elapses, the heating process is stopped. Therefore, the fusing roller can be preheated while restraining noise and power consumption.

According to the second aspect of the invention, when trigger signals for starting preheating are entered a plurality of times during the period from one fusing process to a next fusing process carried out by the fusing roller, the preheating operation is not carried out for entries of trigger signals from the second time onward. Therefore, overheating of the interior of the image forming apparatus or increase in power consumption due to repeated preheating operations is avoided.

According to the third aspect of the invention, when the trigger signal is entered for a first time during a period from one fusing process to a next fusing process carried out by the fusing roller, preheating is carried out without operating the cooling fan. However, when trigger signals from a second time onward are entered, the fusing roller is preheated with the cooling fan operated. Therefore, the fusing roller is preheated while considering noise and power consumption caused by the operation of the cooling fan, and overheating of the interior of the image forming apparatus caused by preheating.

According to the fourth aspect of the invention, preheating of the fusing roller is started in association with opening of the platen cover of the flat bed scanner, set-up of the document on the auto document feeder unit, or selection of a Copy mode. The copying process (printing process) can therefore be carried out immediately when a start button for carrying out the copying process is actually operated.

Other features, elements, processes, steps, characteristics and advantages of the present invention will become more apparent from the following detailed description of embodiments of the present invention with reference to the attached drawings.

DETAILED DESCRIPTION OF EMBODIMENTS OF THE INVENTION

Figure 1:
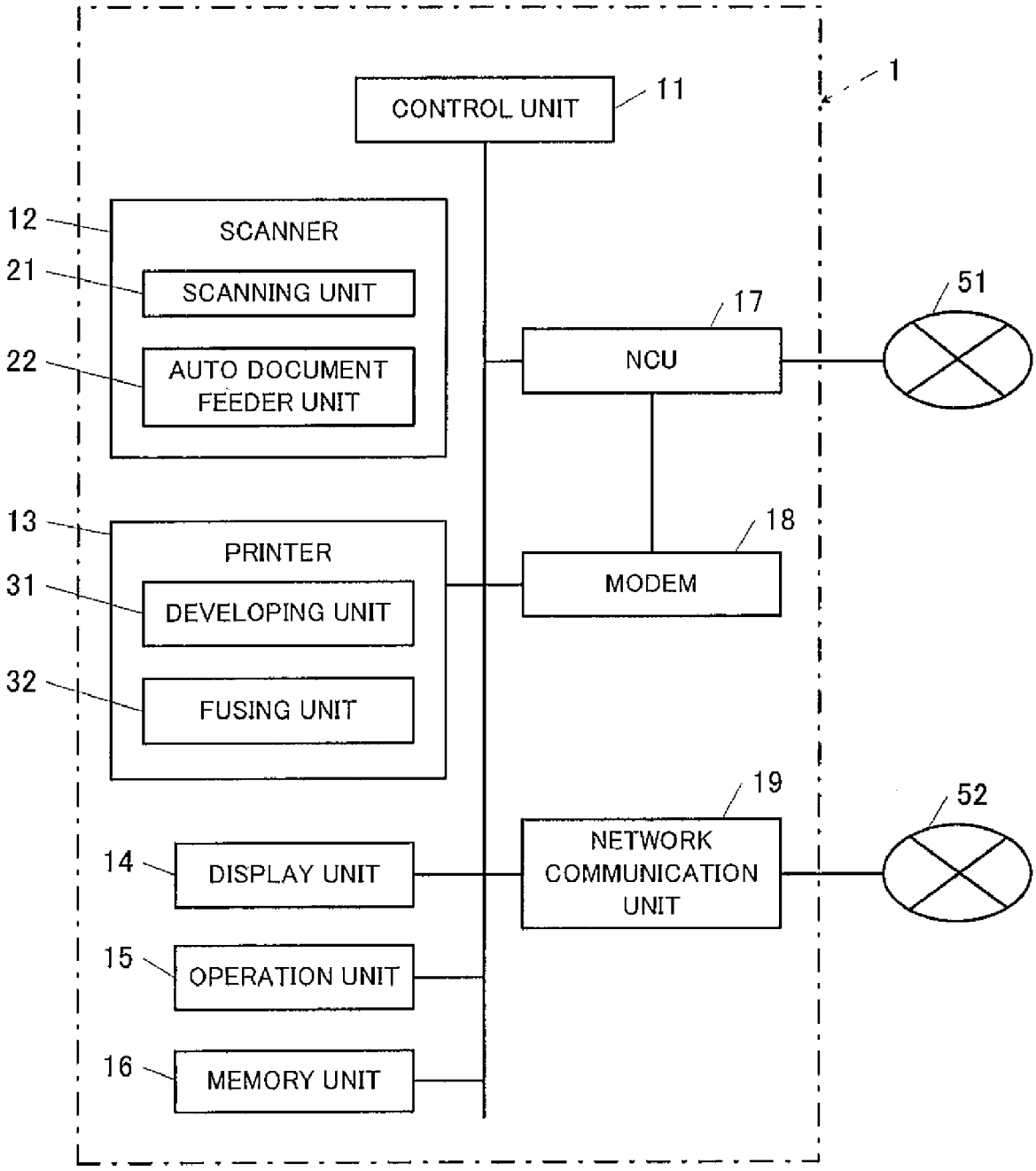
FIG. 1 is a block diagram of a facsimile multifunction peripheral according to an embodiment of the invention.
Figure 2:
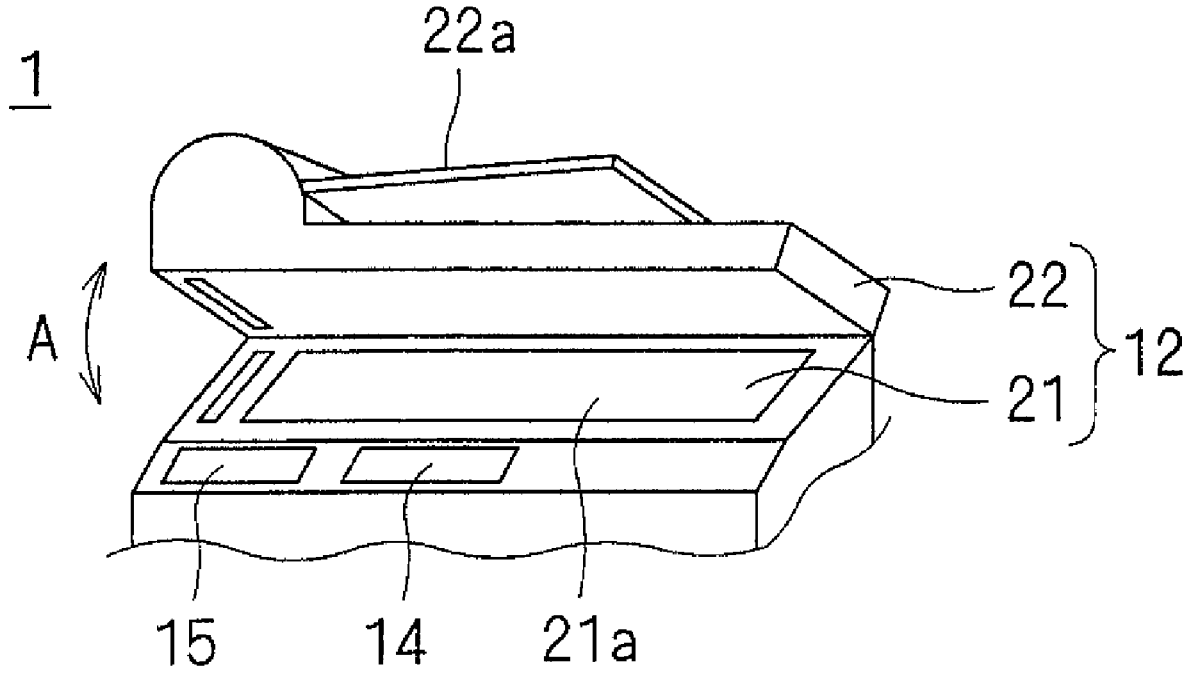
FIG. 2 is a perspective sketch of an upper portion of the facsimile multifunction peripheral.

FIG. 1 is a block diagram of a facsimile multifunction peripheral according to an embodiment of the invention. FIG. 2 is a perspective sketch of an upper portion of the facsimile multifunction peripheral of FIG. 1. A facsimile multifunction peripheral 1 includes a control unit 11, a scanner 12, a printer 13, a display unit 14, an operation unit 15, a memory unit 16, a modulator and demodulator (MODEM) 18, a network control unit (NCU) 17 and a network communication unit 19 as shown in FIGS. 1 and 2. The facsimile multifunction peripheral 1 includes a facsimile function, a copying function, a scanning function and a printer function.

The control unit 11 supervises control of the facsimile multifunction peripheral 1, and includes a central processing unit (CPU).

The scanner 12 scans a document, and reads the document when transmitting facsimile, and reads the document when using the scanner function. The scanner 12 includes a scanning unit 21 as a flat bed scanner that scans the document, and an auto document feeder (ADF) unit 22 that feeds the document to the scanning unit 21. The ADF unit 22 can be opened and closed as shown by an arrow A in FIG. 2, and also covers a platen surface 21*a* of the scanning unit 21.

The scanner 12 is provided with a detection switch 12*a* (see FIG. 3) for detecting that the ADF unit 22 is opened, and a detection switch 12*b* (see FIG. 3) for detecting that a document is placed on a platen 22*a* of the ADF unit 22.

Figure 3:
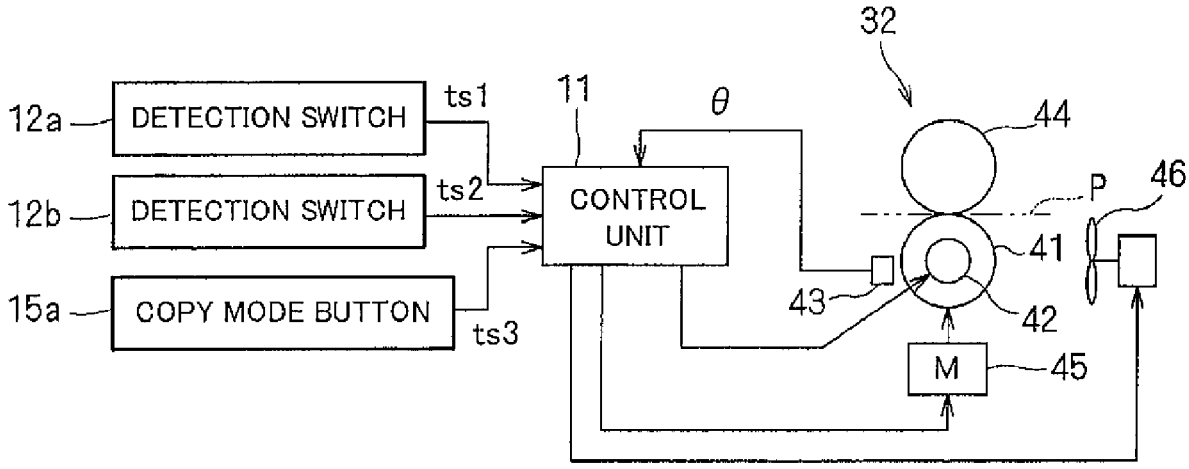
FIG. 3 is a block diagram of a principal portion of the facsimile multifunction peripheral of FIG. 1.

The printer 13 includes a developing unit 31 and a fusing unit 32, and prints document data on a recording medium such as recording paper P (see FIG. 3). The developing unit 31 includes a development roller, not illustrated, so that a toner (developed) image formed on the basis of document data using the development roller is transferred to the recording paper P.

As shown in FIG. 3, the fusing unit 32 includes a fusing roller 41 for heating and fusing the toner image transferred to the recording paper P, a heater 42 for heating the fusing roller 41, a temperature sensor (for example, a thermistor) 43 for detecting the temperature θ of the fusing roller 41, a nip roller 44 for nipping the recording paper P in cooperation with the fusing roller 41 in a pressurized state, a motor 45 for rotating the fusing roller 41 and a cooling fan 46 for cooling the fusing unit 32 and the peripheral components. In this embodiment, the temperature of the fusing roller 41 is detected by the temperature sensor 43. However, it is also possible to detect the temperature of the peripheral components (for example, the nip roller 44) of the fusing roller 41 by the temperature sensor 43, and to use the detected temperature θ for controlling the temperature of the fusing roller 41. In this embodiment, the fusing roller 41 is rotated by the motor 45. However, it is also possible to rotate the nip roller 44 by the motor 45 since the fusing roller 41 and the nip roller 44 are rotated simultaneously in a state of being pressed against each other.

Temperature control of the fusing roller 41 by the heater 42 is carried out by the control unit 11 on the basis of the detection result from the temperature sensor 43. The control unit 11 also controls the motor 45 and the cooling fan 46.

The fusing roller 41 is heated to a predetermined fusing temperature θf (for example, 175° C.) by the heater 42 when carrying out fusing. Then, when printing, the fusing roller 41 and the nip roller 44 are rotated by the motor 45 in a state in which the fusing roller 41 is heated to the fusing temperature θf, and the recording paper P having a toner image transferred thereto is fed into the nip of the rollers 41 and 44. When the recording paper P is fed, the toner image transferred to the recording paper P is heated by the fusing roller 41, and is fused on the recording paper P. When fusing, the cooling fan 46 rotates to cool the fusing unit 32. When the heater 42 is turned off after having finished the printing process, the temperatures of the fusing roller 41 and the periphery thereof are lowered to the room temperature with time.

In this embodiment, the fusing roller 41 is preheated on the basis of trigger signals for starting preheating provided prior to a print command. This point will be described in detail later.

The display unit 14 is composed of a liquid crystal display, and displays information for operating the facsimile multifunction peripheral 1. The operation unit 15 includes a plurality of operating buttons or a touch screen, and is used for operating the facsimile multifunction peripheral 1. For example, the operation unit 15 is provided with a mode selection button (such as copy mode button 15*a* in FIG. 3) for switching an operation mode of the facsimile multifunction peripheral 1 among copy, facsimile and scanner modes.

The memory unit 16 includes a storage device such as a solid-state memory. Document data which is read using the scanner function and data relating to the set-up parameters or maintenance management of the facsimile multifunction peripheral 1 are stored in the memory unit 16.

The MODEM 18 includes a facsimile modem which can carry out facsimile transmission. The MODEM 18 is directly connected to the NCU 17. The NCU 17 is hardware for connecting and releasing a line with respect to an analogue public switched telephone network (PSTN) 51, and connects the MODEM 18 with the PSTN 51 as needed. It is also possible to provide an Integrated Services Digital Network (ISDN) interface and connect to the ISDN.

The network communication unit 19 functions as an interface for connecting the facsimile multifunction peripheral 1 to a network 52 including LAN and Internet, and sends and receives data via the LAN or the Internet.

Referring now to flowcharts in FIG. 4 and FIG. 5, control for preheating the fusing roller 41 by the control unit 11 will be described.

The control unit 11 carries out control to start heating of the fusing roller 41 in association with entry of a print command as well as control to preheat the fusing roller 41 in response to trigger signals for starting preheating provided prior to actual provision of a print command. When a print command is actually given in a state in which the preheating is already started, heating of the fusing roller 41 is continued.

A print command is generated, for example, when the copy mode button in the operation unit 15 is pressed, when printing a received facsimile message, and when a print job is received via the network 52.

The trigger signals for starting preheating are, for example, signals which are generated before starting a copying process, and which are effective as a trigger for starting preparation of the printing process. More specifically, in this embodiment, a signal ts1 for opening the ADF unit 22 (cover) by the detection switch 12*a* in a state in which the facsimile multifunction peripheral 1 is in a Copy mode, a signal ts2 that detects the document on the platen 22*a* by the detection switch 12*b* in the state in which the facsimile multifunction peripheral 1 is in a Copy mode, and a signal ts3 in association with the operation of the copy mode button 15*a* are used as the trigger signals for starting preheating.

Figure 4:
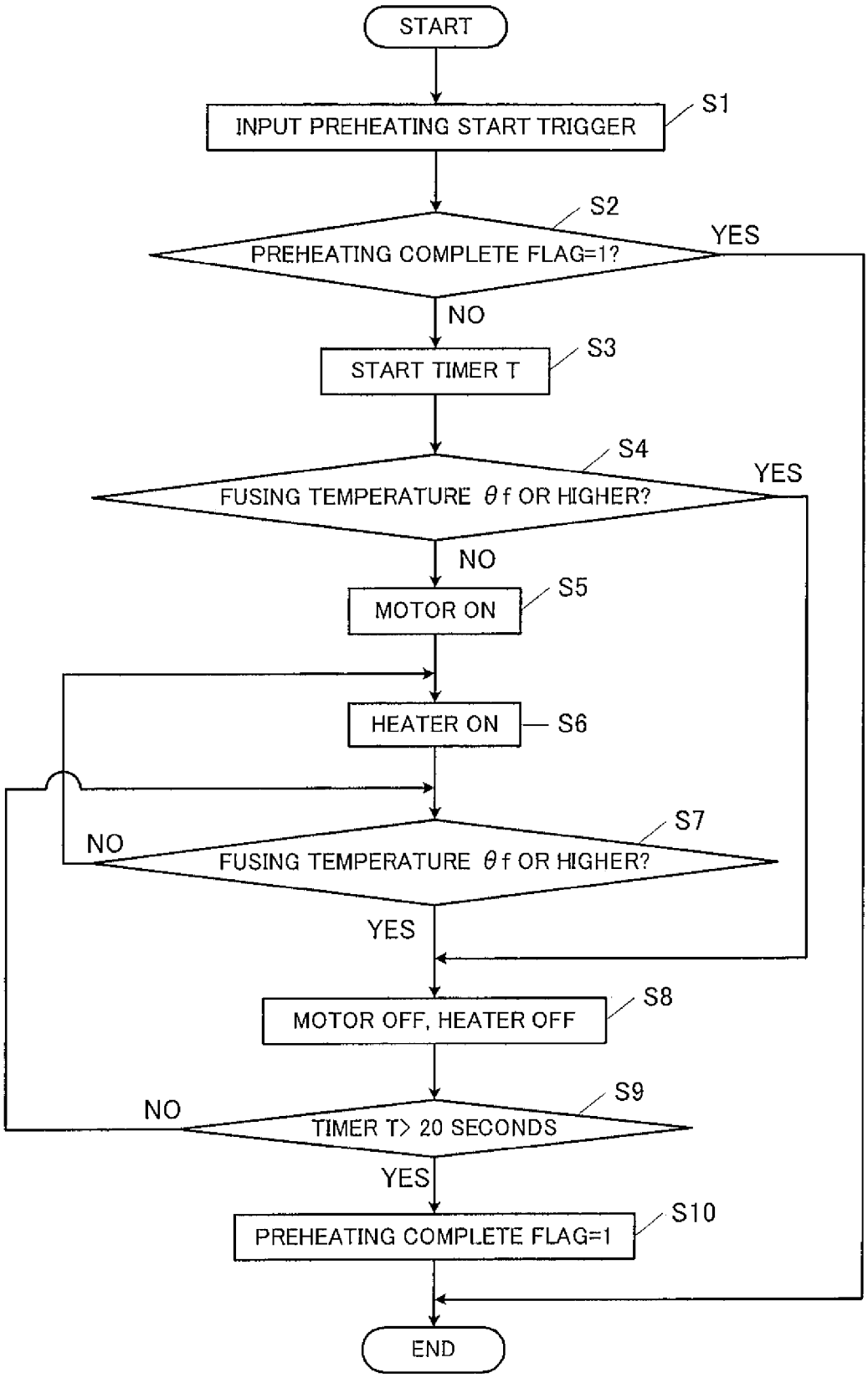
FIG. 4 is a flowchart of a process of preheating a fusing roller.
Figure 5:
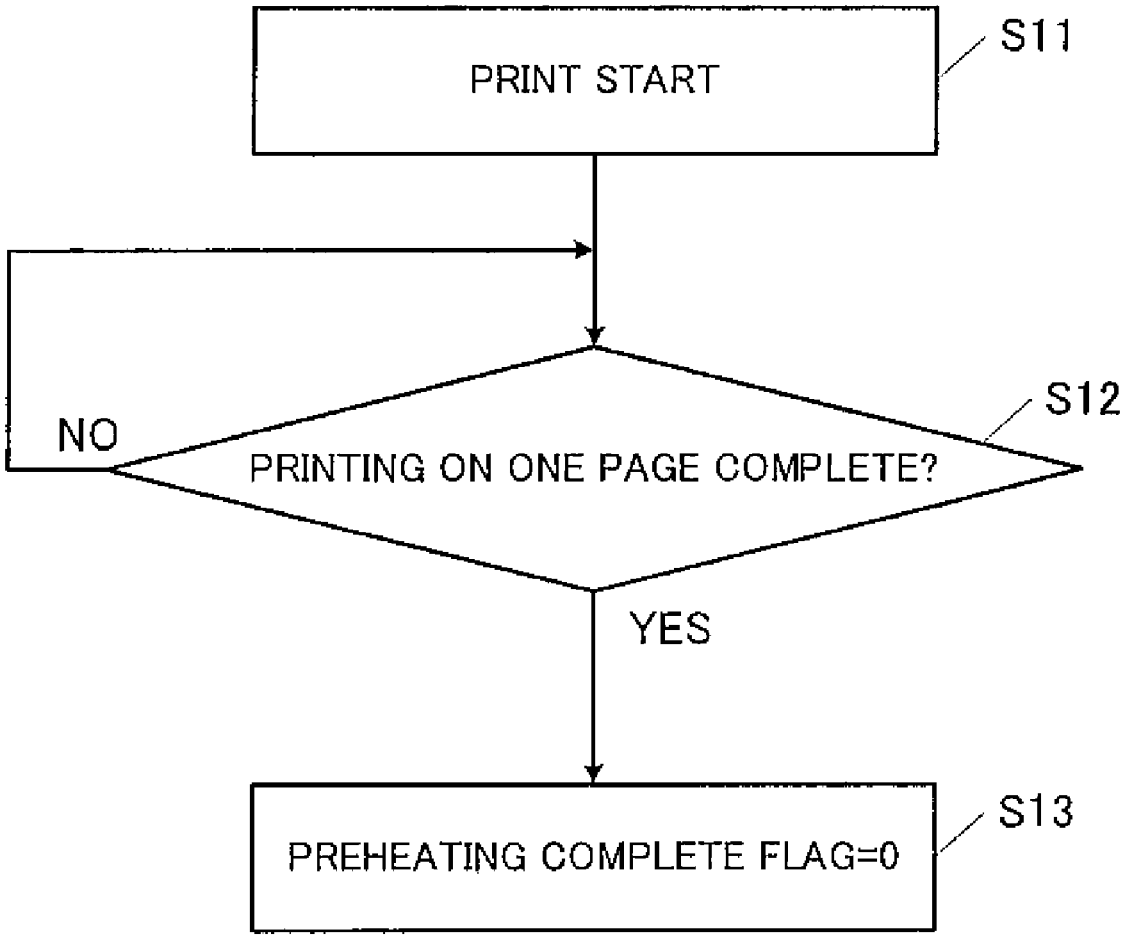
FIG. 5 is a flowchart of a process when a preheating complete flag is initialized.

As shown in FIG. 4, in Step S1, opening of the ADF unit 22 (cover), setting of a document on the platen 22*a*, or operation of the copy mode button 15*a* are carried out in Copy mode, and when the trigger signals for starting preheating are entered, the procedure goes to Step S2.

In Step S2, the control unit 11 determines whether or not a preheating complete flag is set (whether or not the flag value is set to 1). The preheating complete flag is set in Step S10, described later, when preheating for one entry of the trigger signals is completed.

When the preheating complete flag is set in Step S2, the control unit 11 terminates the process without carrying out preheating in order to avoid excessive heating due to repeated preheating and/or increased power consumption. In contrast, when the preheating complete flag is not set (when the flag value is reset to 0), the procedure goes to Step S3, where the process of preheating is carried out.

In Step S3, the control unit 11 activates a timer T to start counting, and the procedure goes to Step S4.

In Step S4, the control unit 11 determines whether or not the temperature θ detected by the temperature sensor 43 is equal to or higher than the fusing temperature θf. When the detected temperature θ is equal to or higher than the fusing temperature θf, it is not necessary to heat the fusing roller 41 any more, and hence the control unit 11 proceeds to the process in Step S8 for turning off the motor 45 and the heater 42 (or for maintaining the OFF state of the motor 45 and the heater 42). On the other hand, when the detected temperature θ is lower than the fusing temperature θf, the motor 45 is turned on in Step S5 to start rotations of the fusing roller 41 and the nip roller 44 and, in subsequent Step S6 the heater 42 is turned on to start heating the fusing roller 41, and then the procedure goes to Step S7. The preheating is carried out in a state in which the cooling fan 46 is stopped.

In Step S7, the control unit 11 determines whether or not the temperature θ detected by the temperature sensor 43 is equal to or higher than the fusing temperature θf. When the detected temperature θ is equal to or higher than the fusing temperature θf, the motor 45 and the heater 42 are turned off in Step S8 to stop rotations of the fusing roller 41 and the nip roller 44, and to stop heating the fusing roller 41, and then the procedure goes to Step S9. On the other hand, when the detected temperature θ is lower than the fusing temperature θf, the procedure goes back to Step S6, where the ON state of the heater 42 (or the ON states of the heater 42 and the motor 45) is maintained.

In Step S9, the control unit 11 determines whether or not the count of the timer T started in Step S3 exceeds a predetermined time period (20 seconds, for example). If the predetermined time has elapsed, the procedure goes to Step S10, where the preheating complete flag is set-up (the flag value is set to 1), and the preheating corresponding to one entry of the trigger signals is terminated. On the other hand, when the predetermined time period has not elapsed from the moment when the count is started (from the moment when the trigger signal is entered), the control unit 11 returns to the process in Step S7, where the processes in Steps S6-S9 are repeated until the predetermined time period has elapsed to turn the heater 42 on and off to maintain the temperature θ detected by the temperature sensor 43 at the fusing temperature θf.

With the processes in Step S1-S10 as described above, when the temperature θ detected by the temperature sensor 43 is lower than the fusing temperature θf, and the trigger signal for starting preheating is entered, the fusing roller 41 is heated while rotating the fusing roller 41 and the nip roller 44 until the detected temperature θ reaches the fusing temperature θf.

Then, when the temperature detected after having entered the trigger signal reaches the fusing temperature θf once, the motor 45 is turned off, and from then onward, preheating is carried out just by controlling the temperature of the heater 42, with the fusing roller 41 and the nip roller 44 stopped, until the predetermined time period by the timer T is completed.

The control unit 11 is adapted to initialize the preheating complete flag (reset the flag value to 0) in association with the printing process being carried out. In other words, as shown in FIG. 5, when the printing process is started in Step S11, the procedure goes to Step S12 to determine whether or not the printing process for one page is completed. When the printing process for one page is completed, the procedure goes to Step S13, where the preheating complete flag is initialized (the flag value is set to 0).

As described thus far, according to this embodiment, when the trigger signals (ts1, ts2 and ts3) for starting preheating are provided prior to the print command, preheating of the fusing roller 41 is started correspondingly. Therefore, the printing process can be carried out immediately when the print command is actually provided. In particular, according to this embodiment, since preheating of the fusing roller 41 is immediately started in association with opening of the ADF unit 22 (cover), set-up of the document on the ADF unit 22, and selection of Copy mode, the copying process (printing process) can be carried out immediately when the copy start button for actually carrying out the copying process.

When the detected temperature of the fusing roller 41 is lower than the fusing temperature θf when the trigger signals for staring the preheating are entered, the fusing roller 41 is heated while rotating the fusing roller 41 and the nip roller 44 until the detected temperature θ reaches the fusing temperature θf. The fusing roller 41 can therefore be preheated while restraining temperature fluctuations and temperature differences from the peripheral components (for example, the nip roller 44) of the fusing roller 41 by rotating the fusing roller 41 and the nip roller 44.

When the temperature of the fusing roller 41 reaches the fusing temperature θf once after having entered the trigger signals, the motor 45 is stopped and preheating is carried out with the rotations of the fusing roller 41 and the nip roller 44 stopped. When the predetermined time period is elapsed from the timing when the trigger signals are entered, the heater 42 is turned off. Therefore, the fusing roller 41 can be preheated while restraining noise and power consumption.

In a case in which trigger signals for staring preheating are entered a plurality of times during a period from a printing process to a next printing process, preheating is not carried out for entries of the trigger signals from the second time onward. Therefore, overheating in the facsimile multifunction peripheral 1 or increased power consumption by carrying out preheating a plurality of times is avoided.

In the embodiment described above, preheating is not carried out for entries of trigger signals from the second time onward entered during the period from one printing process to a next printing process. However, on this point, the following configuration may be employed as a modification.

For example, during the period from one printing process to a next printing process, when the trigger signals are entered for the first time, preheating (Steps S3-S9) is carried out without operating the cooling fan 46, and when the trigger signals from the second time onward are entered, preheating (Steps S3-S9) is carried out with the cooling fan 46 operated. When this configuration is employed, preheating of the fusing roller 41 can be carried out while considering noise and power consumption due to operation of the cooling fan 46 and overheating in the facsimile multifunction peripheral 1.

While the present invention has been described with respect to embodiments thereof, it will be apparent to those skilled in the art that the invention may be modified in numerous ways and may assume many embodiments other than those specifically set out and described above. Accordingly, the appended claims are intended to cover all modifications that fall within the true spirit and scope of the present invention.

What is claimed is:

1. An image forming apparatus comprising;

a fusing roller that heats and fuses a developed image transferred to a recording medium;

a heat generator that heats the fusing roller;

a temperature detection sensor that detects the temperature of the fusing roller or of the periphery thereof;

a motor that rotates the fusing roller;

a control unit that controls the heat generator and the motor on the basis of a detected temperature from the temperature detection sensor; and a cooling fan controlled by the control unit for cooling the fusing roller and the periphery thereof, wherein the control unit controls the heat generator to maintain the detected temperature at a reference fusing temperature until a predetermined time period is elapsed from an entry of a trigger signal for starting preheating provided prior to an entry of a print command and stops the heat generator when the predetermined time period has elapsed, the control unit operates the motor until the detected temperature reaches the reference fusing temperature in a case in which the temperature detected when the trigger signal is entered is lower than the reference fusing temperature, and stops the motor when the detected temperature reaches the reference fusing temperature, the control unit causes preheating to be carried out without operating the cooling fan when the trigger signal is entered for the first time, and the control unit causes preheating to be carried out with the cooling fan operated when trigger signals are entered from a second time onward during a period from one fusing process to a next fusing process carried out by the fusing roller.

2. The image forming apparatus according to claim 1, further comprising a trigger signal generator that generates the trigger signal for starting preheating provided prior to the print command.

3. The image forming apparatus according to claim 2, wherein the trigger signal generator generates the trigger signal in association with opening of a platen cover of a flat bed scanner.

4. The image forming apparatus according to claim 2, wherein the trigger signal generator generates the trigger signal in association with set-up of a document to an auto document feeder unit.

5. The image forming apparatus according to claim 2, further comprising a copy function, wherein the trigger signal generator generates the trigger signal in association with selection of a Copy mode.

6. The image forming apparatus according to claim 1, further comprising a timer that counts the predetermined time period.

7. The image forming apparatus according to claim 1, wherein when trigger signals are entered a plurality of times during a time period from one fusing process to a next fusing process carried out by the fusing roller, the controller does not carry out control to preheat the fusing roller for entries of trigger signals from the second time onward.

8. An image forming apparatus comprising;

means for including a fusing roller for heating and fusing a developed image transferred to a recording medium;

means for heating the fusing roller;

means for detecting the temperature of the fusing roller or of the periphery thereof;

means for rotating the fusing roller;

means for controlling the means for heating the fusing roller and the means for rotating the fusing roller on the basis of the detected temperature; and cooling means controlled by the controlling means for cooling the fusing roller and the periphery thereof, wherein the detected temperature is controlled to be maintained at a reference fusing temperature until a predetermined time period is elapsed from when a trigger signal for starting preheating provided prior to an entry of a print command is entered, and heating is stopped in association with elapse of the predetermined time period, the fusing roller is rotated until the detected temperature reaches the reference fusing temperature when the temperature detected at the time of the entry of the trigger signal is lower than the reference fusing temperature, and the fusing roller is stopped when the detected temperature reaches the reference fusing temperature, the controlling means causes preheating to be carried out without operating the cooling means when the trigger signal is entered for the first time, and the controlling means causes preheating to be carried out with the cooling means operated when trigger signals are entered from a second time onward during a period from one fusing process to a next fusing process carried out by the fusing roller.

9. The image forming apparatus according to claim 8, further comprising means for generating the trigger signal.

10. The image forming apparatus according to claim 9, wherein the trigger signal is generated in association with opening of a platen cover of a flat bed scanner.

11. The image forming apparatus according to claim 9, wherein the trigger signal is generated in association with set-up of a document to an auto document feeder unit.

12. The image forming apparatus according to claim 9, further comprising means for copying, wherein the trigger signal is generated in association with selection of Copy mode.

13. The image forming apparatus according to claim 8, further comprising means for counting the predetermined time period.

14. The image forming apparatus according to claim 8, wherein preheating is not carried out for entries of trigger signals from a second time onward when trigger signals are entered a plurality of times during a time period from one fusing process to a next fusing process carried out by the fusing roller.

15. A method for preheating an image forming apparatus before receiving a print command comprising:

receiving a preheating trigger signal;

detecting the temperature of a fusing roller;

if the detected temperature is lower than a fusing temperature, rotating and heating the fusing roller until the detected temperature reaches the fusing temperature;

once the detected temperature reaches the fusing temperature in response to the preheating trigger signal, and until a predetermined time period elapses, maintaining the detected temperature at the fusing temperature by heating and not rotating the fusing roller;

carrying out preheating without operating a cooling means when the trigger signal is entered for the first time; and carrying out preheating with the cooling means operated when trigger signals are entered from a second time onward during a period from one fusing process to a next fusing process carried out by the fusing roller.

16. The method according to claim 15 wherein, preheating is not carried out again for subsequent trigger signals received until the predetermined time period following receipt of the initial trigger signal has elapsed.

17. The method according to claim 15, and further comprising:

generating the trigger signal when a platen cover of a flat bed scanner is opened.

18. The method according to claim 15, and further comprising:

generating the trigger signal when a document is set in an auto document feeder unit.

19. The method according to claim 15, and further comprising:

generating the trigger signal when a Copy mode is selected.

* * * * *